United States Patent [19]

Ofusa et al.

[11] Patent Number: 4,678,013

[45] Date of Patent: Jul. 7, 1987

[54] WOVEN SLIDE FASTENER

[75] Inventors: Masaatsu Ofusa, Toyama; Toshio Ishihama, Osaka, both of Japan

[73] Assignee: Yoshida Kogyo K. K., Tokyo, Japan

[21] Appl. No.: 656,774

[22] Filed: Oct. 1, 1984

[30] Foreign Application Priority Data

Oct. 12, 1983 [JP] Japan ..... 58-157484[U]
Oct. 12, 1983 [JP] Japan ..... 58-157485[U]
Oct. 12, 1983 [JP] Japan ..... 58-157486[U]

[51] Int. Cl.[4] ..... D03D 1/00; A44B 19/34
[52] U.S. Cl. ..... 139/384 B; 24/392
[58] Field of Search ..... 139/384 B; 24/392, 393

[56] References Cited

U.S. PATENT DOCUMENTS

| | | | |
|---|---|---|---|
| 3,524,479 | 8/1970 | Burbank | 139/384 B |
| 3,961,652 | 6/1976 | Hasuda et al. | 139/384 B |
| 4,191,220 | 3/1980 | Yoshida | 139/384 B |
| 4,210,180 | 7/1980 | Tsubata | 139/384 B |
| 4,383,558 | 5/1983 | Tsubata et al. | 139/384 B |

*Primary Examiner*—James Kee Chi
*Attorney, Agent, or Firm*—Hill, Van Santen, Steadman & Simpson

[57] ABSTRACT

Disclosed is a woven slide fastener including a row of fastener elements composed of a flat coil formed of a continuous monofilament, and a slide fastener tape having the row of fastener elements woven into a longitudinal side edge thereof. Each fastener element includes a coupling head and upper and lower leg portions joined thereto. Binding warp threads extend along the upper and lower sides of the fastener element row and are woven into the tape along with other warp threads and a weft thread to form a portion where the tape and fastener element row are mutually interwoven, thereby maintaining the perpendicularity of the leg portions with respect to the tape, the stability of the spacing between mutually adjacent ones of the fastener elements, and the smoothness with which the row of fastener elements is coupled with an opposing row of fastener elements.

6 Claims, 20 Drawing Figures

WOVEN SLIDE FASTENER

BACKGROUND OF THE INVENTION

This invention relates to a woven slide fastener of the type in which a row of slide fastener elements comprising a continuous monofilament made of synthetic resin or metal and formed into a flat coil are woven together with warp and weft threads so as to be woven integrally into a portion of a slide fastener tape.

DESCRIPTION OF THE PRIOR ART

Slide fasteners well-known in the art include so-called "woven slide fasteners" in which a row of fastener elements formed of a continuous monofilament having the shape of a flat coil are woven into a portion of a slide fastener tape together with the warp and weft threads that construct the tape web. Prime examples of such woven slide fasteners are disclosed in the specifications of Japanese Patent Publication (Kokoku) Nos. 46-7018, 57-20802 and Japanese Laid-Open Patent Publication (Kokai) No. 56-60504. All of these conventional woven slide fasteners possess a variety of shortcomings. For example, according to the disclosures in the specification of Japanese Patent Publication No. 46-7018, the fastener element row is simply beaten into a warp together with a weft to form the tape structure. This results in a woven slide fastener having poor stability in the direction of element pitch and makes it difficult to maintain the upper and lower leg portions of each element perpendicular to the tape surface. While the invention described in the specification of Japanese Laid-Open Patent Publication No. 56-60504 attempts to enhance the resistance of the fastener elements against twisting or skewing by means of a supporting pad disposed between the upper and lower leg portions of the coupling head of each element, a drawback ascribable to the supporting pad is a pronounced increase in thickness in the vicinity of the coupling head as compared with the thickness of the tape. Further, though the invention disclosed in the specification of Japanese Patent Publication No. 57-20802 manages to stabilize coupling head spacing by forming the fastener elements into a configuration in which both legs thereof closely contact each other and are compressed by the warp threads, looseness tends to develop between the tape and fastener element since a reliable connection between the two cannot be obtained.

SUMMARY OF THE INVENTION

The first object of the present invention is to provide a woven slide fastener representing an improvement over the above-described prior art having the aforesaid disadvantages, which woven slide fastener exhibits excellent perpendicularity between a tape surface and both legs of the fastener elements as well as a highly stable spacing between neighboring coupling heads, and which is adapted to provide smooth coupling between opposing elements.

According to the present invention, the first object is attained by providing a woven slide fastener which comprises: a fastener element row in the form of a flat coil composed of a continuous monofilament having a number of turns, each turn of the flat coil constituting a separate fastener element having a single coupling head, an upper leg and a lower leg, each fastener element including a heel formed by bending the continuous monofilament near a boundary of a neighboring fastener element substantially in a plane containing an axis of the flat coil, the coupling head being formed by bending the continuous monofilament in a plane substantially orthogonal to the axis of the flat coil; a slide fastener tape including a tape body having a first longitudinal tape edge into which the fastener elements are woven and a second longitudinal tape edge opposite said first longitudinal tape edge; first warp threads woven into the tape body; second warp threads woven into the first longitudinal tape edge; an upper binding warp thread positioned outside of the upper legs and nearer to the coupling heads than said second warp threads and extending along an upper side of said fastener element row; a lower binding warp thread positioned outside of the lower legs and nearer to the coupling heads than said second warp thread and extending along a lower side of said fastener element row; and a weft thread woven into said first and second warp threads so as to cross and interlace with said upper and lower binding warp threads.

A second object of the present invention is to provide a highly durable woven slide fastener in which the fastener elements are retained in reliable fashion without binding warps shifting on the elements in the direction of the coupling heads or in the direction of heel portions of the elements.

A third object of the present invention is to improve the yield of manufacture, raise machining speed and lower manufacturing cost by facilitating the holding of binding warp threads at prescribed positions during weaving.

The second and third objects are attained by providing each fastener element with upper and lower retaining grooves formed in the continuous monofilament on the upper and lower legs, the upper retaining groove receiving the upper binding warp thread, and the lower retaining groove receiving the lower binding warp thread.

A fourth object of the present invention is to further enhance the effect of filling the spacing between neighboring fastener elements.

The fourth object is attained by providing at least two upper binding warp threads, all of the upper binding warp threads save at least one crossing and interlacing with the weft thread at all times.

The above and other objects, features and advantages of the invention will be more apparent from the ensuing detailed description taken in connection with the accompanying drawings.

DETAILED DESCRIPTION OF THE PREFERRED EMBODIMENTS

Figure 5:
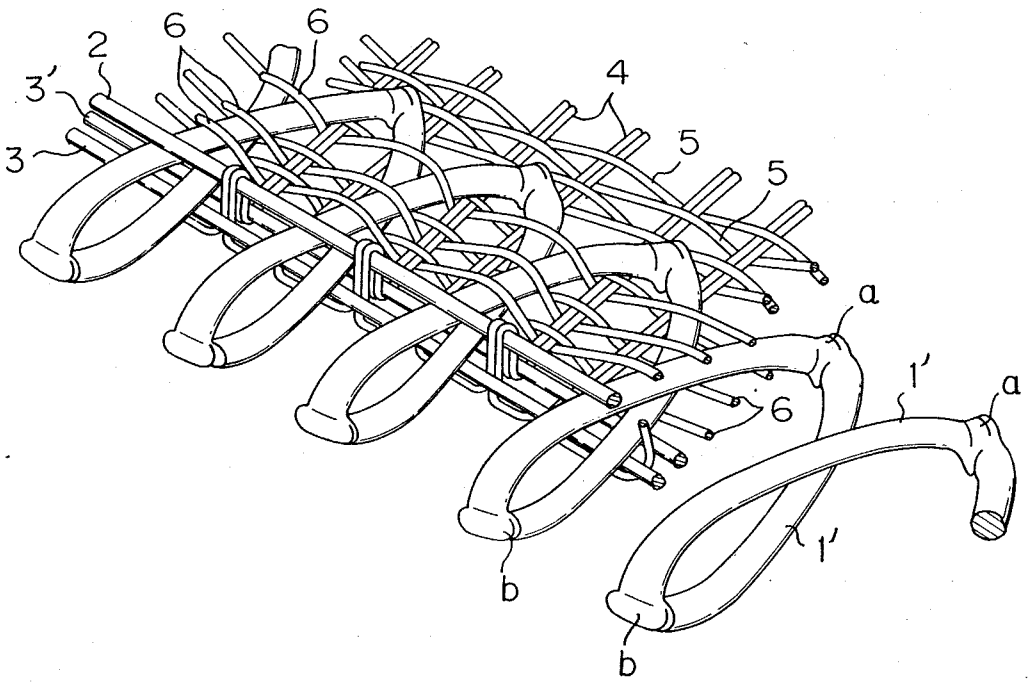
FIG. 5 is a perspective view illustrating part of a second embodiment of the present invention.
Figure 6:
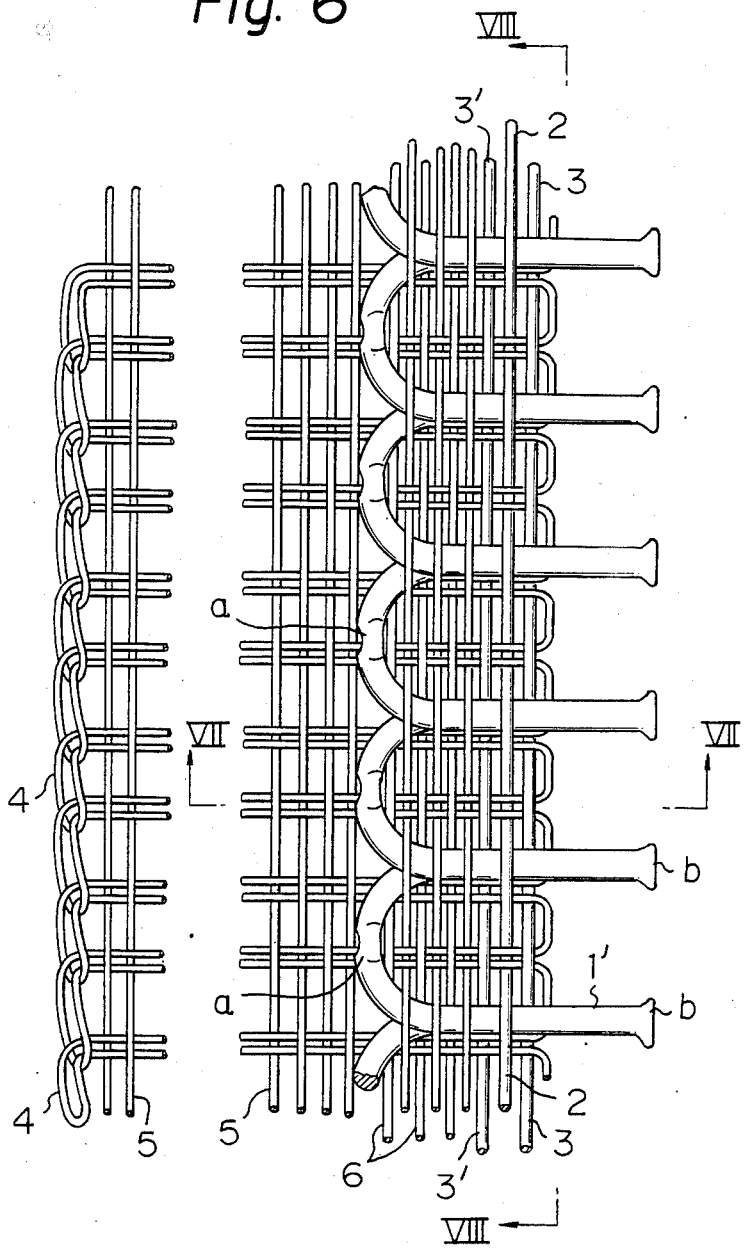
FIG. 6 is a plan view of the second embodiment.
Figure 7:
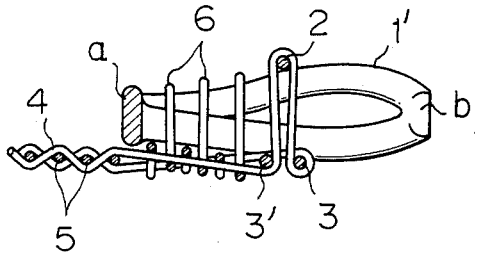
FIG. 7 is a transverse sectional view taken along line VII—VII of FIG. 6.
Figure 8:
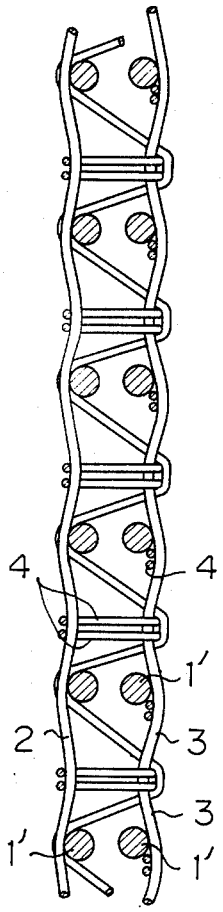
FIG. 8 is a longitudinal sectional view taken along line VIII—VIII of FIG. 6.

FIGS. 1 through 4 illustrate a first embodiment of a woven slide fastener according to the present invention. In order to picture the relationship among warp threads, a weft thread and the coiled monofilament more clearly, the threads are shown to be more slender than they are in actuality. It should be noted, therefore, that the spacing between the threads and the continuous monofilament will be exaggerated and appear larger than they are in actuality. The same will hold for the embodiments shown in FIG. 5 onward.

Figure 1:
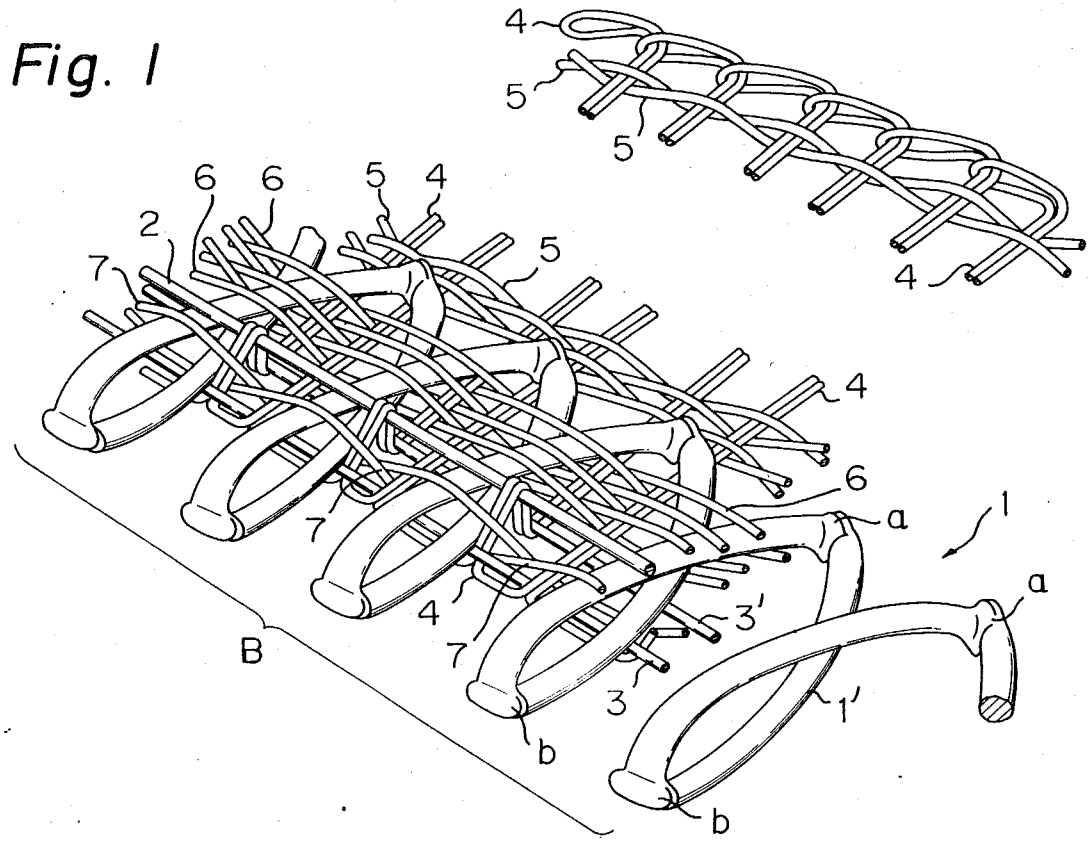
FIG. 1 is a perspective view illustrating part of a first embodiment of the present invention.
Figure 2:
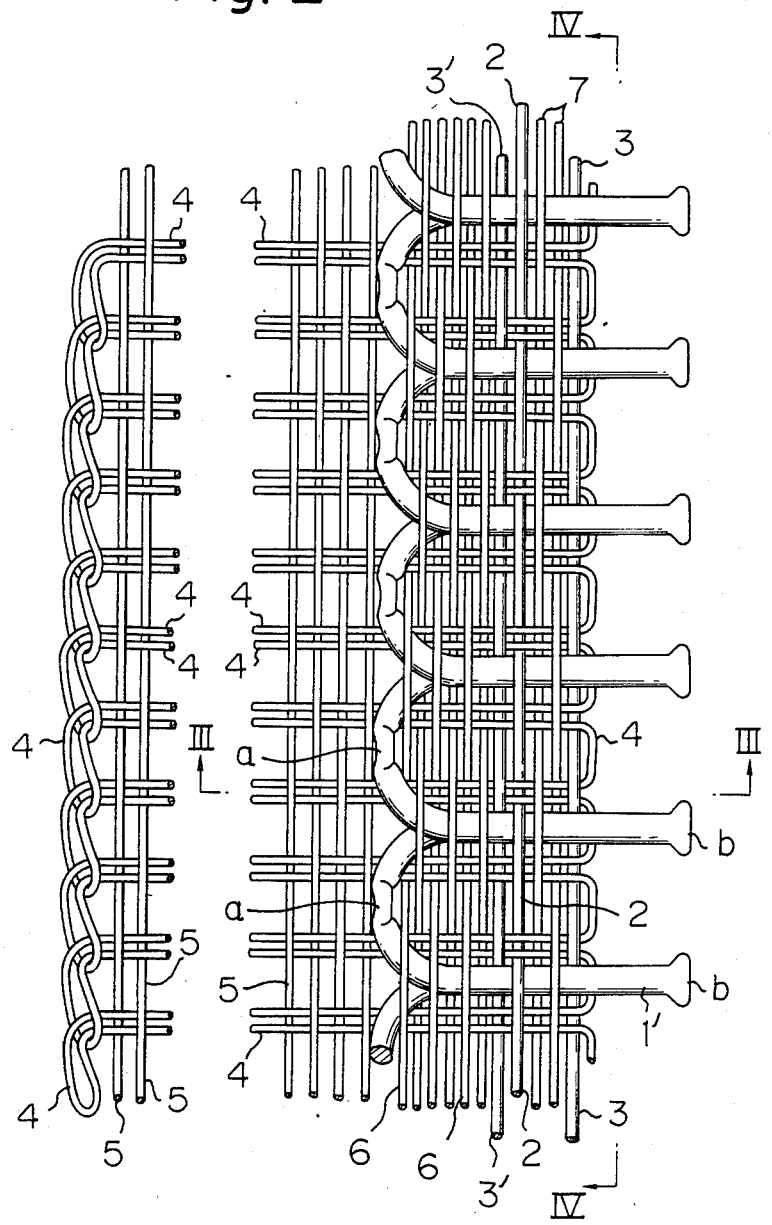
FIG. 2 is a plan view of the first embodiment.
Figure 3:
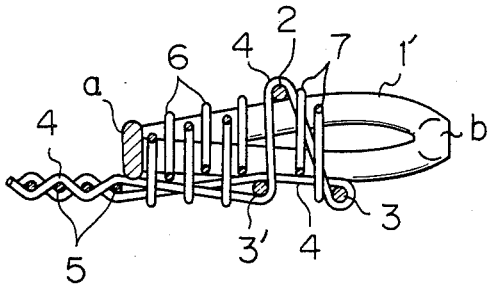
FIG. 3 is a transverse sectional view taken along line III—III of FIG. 2.
Figure 4:
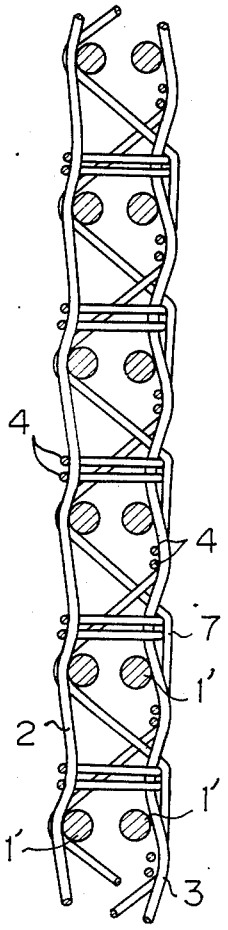
FIG. 4 is a longitudinal sectional view taken along line IV—IV of FIG. 2.

FIG. 1 is a perspective view illustrating a principal portion of a woven fastener which includes a continuous, synthetic resin monofilament supplied as a double weft and woven into one longitudinal side edge of a fastener tape as the tape is being woven. A flat coil 1 comprises a continuous monofilament 1', which has been deformed under pressure at regular intervals, and is produced by winding the monofilament 1' into a coil while the monofilament is bent at the deformed portions to form heel portions a and coupling head portions b. Each heel portion a is formed by bending the monofilament 1' back over itself in a plane containing the longitudinal axis of the coil, or in a plane which is inclined slightly with respect to the first-mentioned plane. Each coupling head portion b is formed by bending the monofilament 1' in a plane which is generally perpendicular to the longitudinal coil axis. Each fastener element unit comprises a coupling head portion b, an upper leg and a lower leg, and is connected at its ends, namely at its heel portions a, with a fastener element unit at either side thereof to construct an element row B forming the flat coil. An upper binding warp thread 2 extends along the upper side of the element row, namely the outer sides of the upper legs, and lower binding warp threads 3, 3' extend along the lower side of the element row, namely outer sides of the lower legs. A weft thread 4 are interlaced with the binding warp threads 2, 3, 3' between the adjacent fastener element unit and tightly secures the binding warp threads 2, 3, 3' from both sides thereof, extends outwardly of the coil beyond the heel portions a and is interlaced with the other warp threads 5 to form a tape web. The weft thread 4 forms a loop at the longitudinal side edge of the tape web, with mutually adjacent individual loops being intertwined to form an ear portion along the side edge of the tape. A warp thread 5 is interlaced with the weft thread 4 to form the tape web. A warp thread 6 for fastening the coil is woven in at 2/2 with respect to the weft thread 4 and at 1/1 with respect to the double weft threads of the continuous monofilament 1', and is interlaced with the weft thread 4 and with the continuous monofilament 1' of the flat coil 1 to weave in the flat coil as a portion of the tape web. The warp thread 6 is between the binding warp threads 2, 3, 3' and the heel portions a, extends alternatively the upper and lower sides of the fastener element units, namely the outer sides of the upper and lower legs, and is interlaced with the weft thread 4 between the fastener element units. Warp threads 7 are interlaced with the continuous monofilament 1' of the flat coil between the binding warp threads 2, 3, 3' on the upper and lower sides thereof to fill the gaps of the coupling head sides between mutually adjacent coupling elements. The upper binding warp thread 2 and lower binding warp threads 3, 3' are thicker and stronger than the other warp threads and have greater elasticity than the weft thread.

With the above-described arrangement according to the first embodiment of the present invention, the upper binding warp thread 2 and lower binding warp threads 3, 3' make it possible to maintain the perpendicularity of the upper and lower legs of each fastener element unit with respect to the plane of the tape, and to stabilize the spacing between the coupling heads. The warp threads 6 are fastened tightly in such a manner that the continuous monofilament 1' forms a portion of the tape. Since the warp threads 6 are between the binding warp threads 2, 3, 3' and the heel portions, the binding warp threads are prevented from shifting. Furthermore, the warp threads 7, 7 cross each other in the gaps between neighboring fastener element units to fill these gaps, thereby preventing the intrusion of dust and assuring that the upper and lower warp threads will not slide off the fastener elements.

A second embodiment of the present invention is illustrated in FIGS. 5 through 8. Portions corresponding to those of the first embodiment are designated by like reference characters and need not be described again.

The second embodiment of the invention is distinguishable over the first embodiment in that the warp threads 7 for filling the gaps between coupling heads are deleted, and in that the warp threads 6 run along the upper side or along the lower side of the continuous monofilament 1' and are fastened between neighboring elements from below or from above the weft thread 4. In other words, the warp threads for filling the gaps between fastener element units are not an essential structural feature of the present invention.

Figure 9:
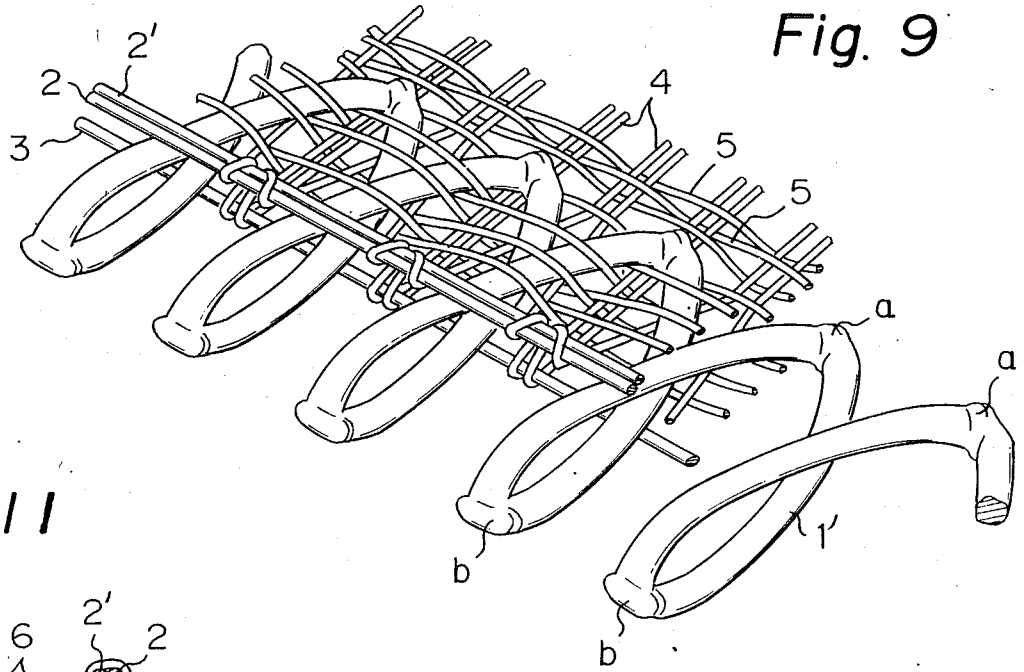
FIG. 9 is a perspective view illustrating part of a third embodiment of the present invention.
Figure 11:
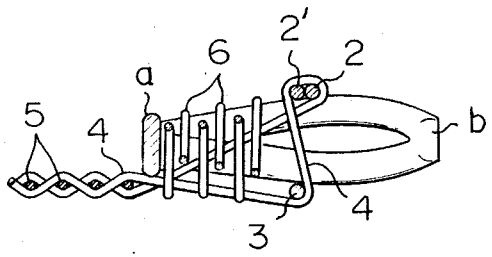
FIG. 11 is a longitudinal sectional view taken along line XI—XI of FIG. 10.
Figure 10:
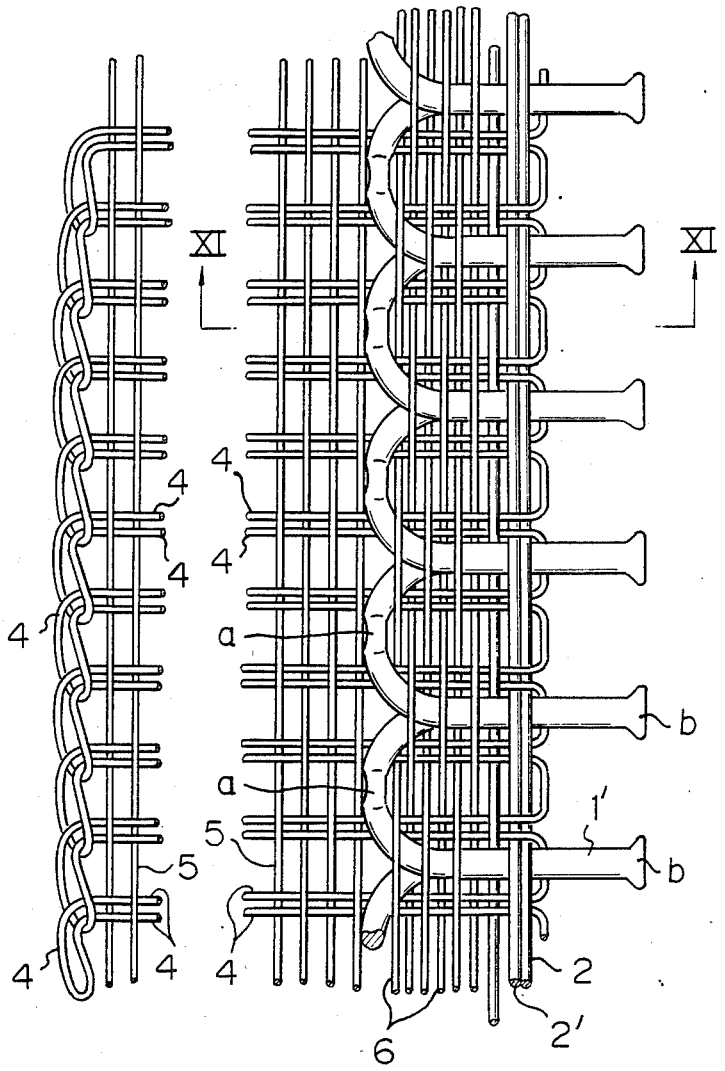
FIG. 10 is a plan view of the third embodiment.

FIGS. 9 through 11 depict a third embodiment of the invention. Portions corresponding to those of the first and second embodiments are designated by like reference characters and are not described again.

The woven slide fastener of the third embodiment is similar to that of the second embodiment in that the warp threads 7 are not provided. The distinguishing feature of this embodiment resides in the fact that the weft thread 4 is interlaced with a pair of upper binding warp threads 2, 2' and with a single lower binding thread 3 in a figure-eight configuration, with the weft thread 4 serving to fill the gaps between adjacent fastener element units as was performed by the warp threads 7 of the first embodiment. More specifically, between adjacent element units, after the weft thread 4 is wound around the upper binding warp threads 2, 2' outwardly from the lower sides thereof, it is passed over the lower binding warp thread 3 outwardly from the upper side thereof and then extended toward the side edge of the tape where it is interlaced with an already existing weft thread loop. This is followed by returning the weft thread 7 as a double pick to the element side of the tape to be passed over the lower binding warp thread 3 outwardly from the lower side thereof and then wound around the upper binding warp threads 2, 2' inwardly from the inner sides thereof, after which the weft thread 7 is again extended toward the side edge of the tape. These steps are repeated to weave the tape along with the various warp threads. Since this embodiment raises the density of the weft threads, greater filling is effected between the fastener elements to stabilize the quality of the manufactured product.

The construction and advantages of each of the three foregoing embodiments are as described above. In particular, in all three of these embodiments, the weft thread is interlaced with the upper and lower binding warp threads between the mutually adjacent fastener elements. This common feature enhances the stability of the elements in the pitch direction and fills the gaps between the elements so that the upper and lower legs of the elements on the coupling side thereof are maintained perpendicular to the feastener tape. This facilitates the smoothness with which the row of fastener elements may couple with the fastener element row on an opposing longitudinal side edge of the slide fastener.

Figure 12:
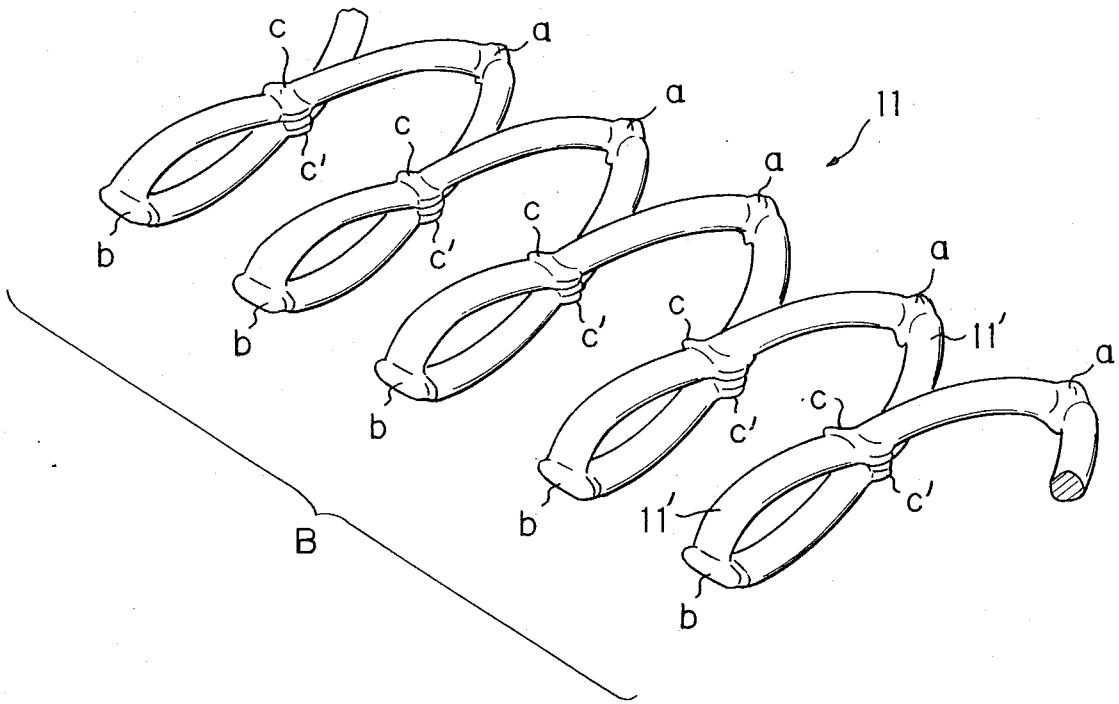
FIG. 12 is a perspective view of a flat coil forming a fastener element row according to a fourth embodiment of the present invention.

FIGS. 13 through 16 illustrate a fourth embodiment of the present invention, and FIG. 12 is a perspective view of a flat coil employed in the fourth embodiment.

Figure 13:
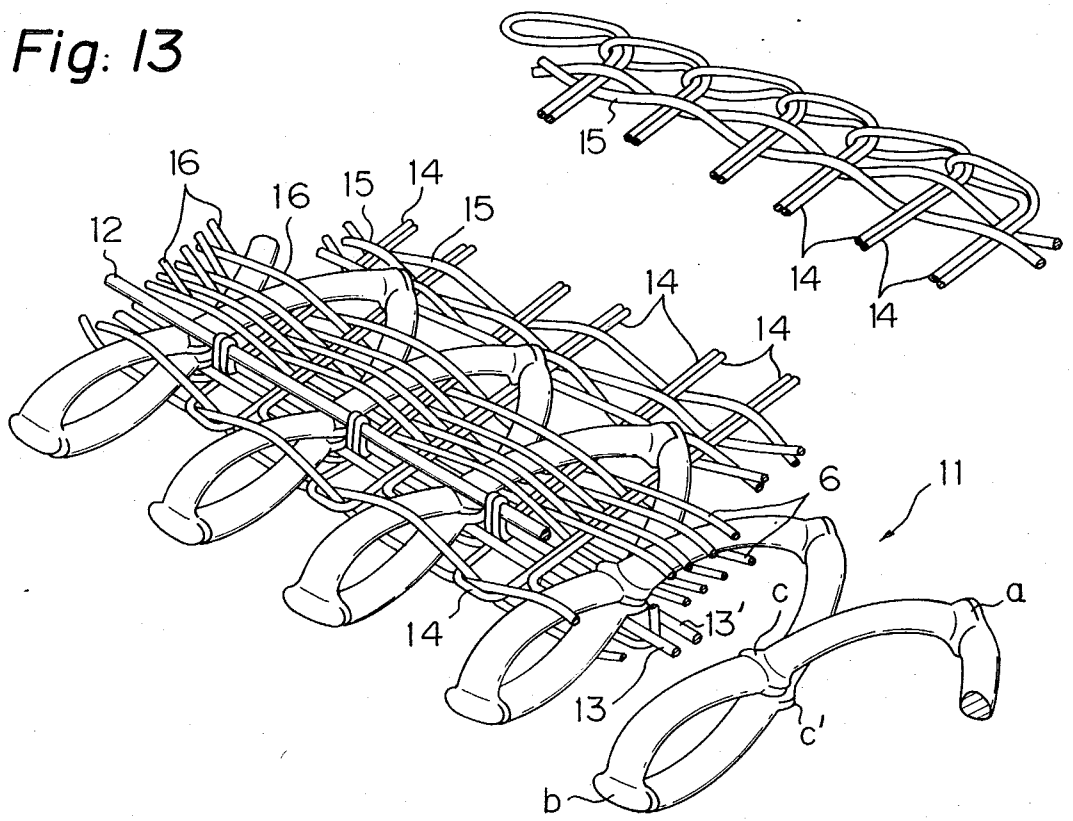
FIG. 13 is a perspective view illustrating part of a fourth embodiment of the present invention.
Figure 14:
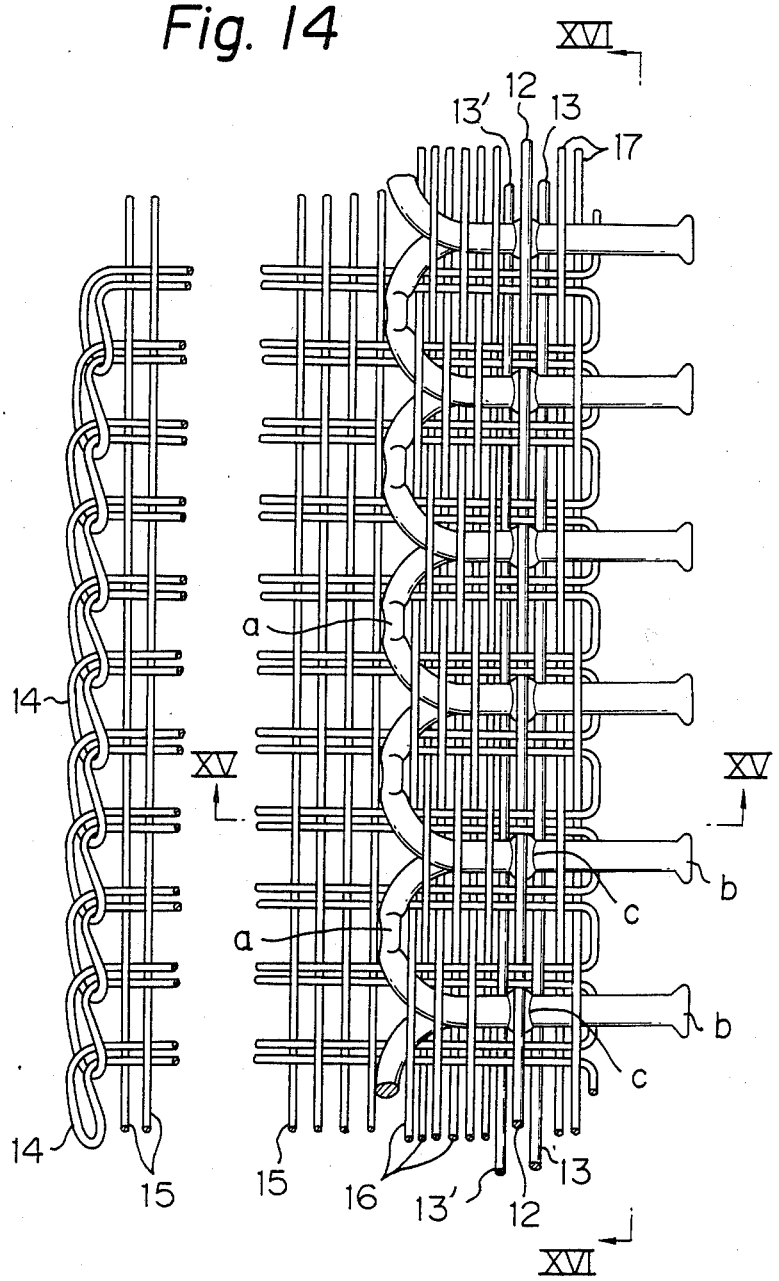
FIG. 14 is a plan view of the embodiment shown in FIG. 13.
Figure 15:
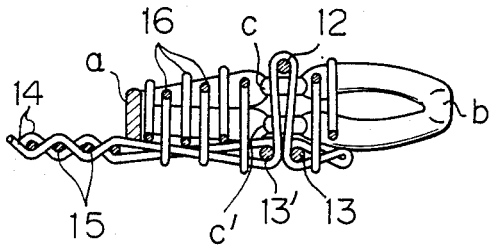
FIG. 15 is a transverse sectional view taken along line XV—XV of FIG. 14.
Figure 16:
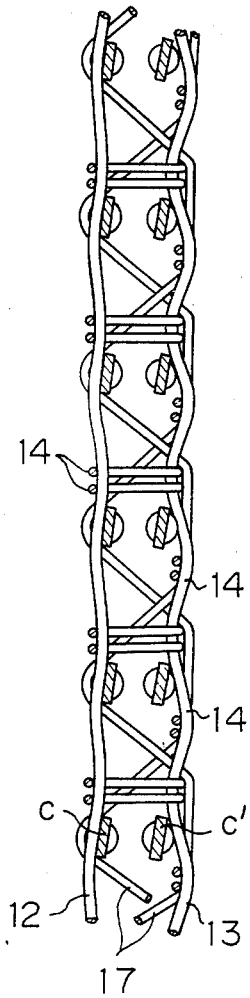
FIG. 16 is a longitudinal sectional view taken along line XVI—XVI of FIG. 14.

FIG. 13 is a perspective view illustrating a principal portion of a woven fastener which includes a continuous, synthetic resin monofilament supplied as a double weft and woven into one longitudinal side edge of a fastener tape as the tape is being woven. A flat coil 11 comprises a continuous monofilament 11', which has been deformed under pressure at regular intervals, and is produced by winding the monofilament 11' into a coil while the monofilament is bent at the deformed portions to form heel portions a and coupling head portions b. Each heel portion a is formed by bending the monofilament 11' back over itself in a plane containing the longitudinal axis of the coil, or in a plane which is inclined slightly with respect to the first-mentioned plane. Each coupling head portion b is formed by bending the monofilament 11' in a plane which is generally perpendicular to the longitudinal coil axis. Each fastener element unit comprises a coupling head b and upper and lower legs, and is connected at the ends of the legs, namely at its heel portions a, with a fastener element unit at either side thereof to construct an element row B forming the flat coil. The outer side each of the legs is provided with upper and lower retaining grooves c, c' formed midway between the heel portions a and coupling head portions b by pressure deformation. The construction of the flat coil 11 employed in the fourth embodiment of the invention will now be described with reference to FIG. 13, which is a perspective view of the coil with a portion thereof cut away.

An upper binding warp thread 12 extends along the upper side of the element row, and lower binding warp threads 13, 13' extend along the lower side of the element row. The upper binding warp thread 12 is held at a prescribed position by the retaining grooves c of the upper legs, while the lower binding warp threads 13, 13' are retained at a prescribed position by the retaining grooves c' of the lower legs. The upper and lower binding warp threads are thus prevented from shifting toward the coupling heads b or heels a and will not slip off the fastener elements. A weft thread 14 is interlaced with the binding warp threads 12, 13, 13' between the fastener element units, and tightly secures the binding warp threads 12, 13, 13' from both sides thereof, extends outwardly of the coil beyond the heel portions a and is interlaced with the other warp threads to form a tape web. The weft thread 14 forms a loop at the longitudinal side edge of the tape web, with mutually adjacent individual loops being intertwined to form an ear portion along the side edge of the tape. A warp thread 15 is interlaced with the weft thread 14 to form the tape web. A warp thread 16 for fastening the coil is woven in at 2/2 with respect to the weft thread 14 and at 1/1 with respect to the double weft threads of the continuous monofilament 11', and is interlaced with the weft thread 14 and with the continuous monofilament 11' of the flat coil 11 to weave the flat coil as a portion of the tape web. Warp threads 17 are interlaced with the continuous monofilament 11' of the flat coil between the binding warp threads 12, 13, 13' on the upper and lower sides thereof to fill the gaps of the coupling head sides between mutually adjacent fastener elements. The upper binding warp thread 12 and lower binding warp threads 13, 13' are thicker and stronger than the other warp threads and have greater elasticity than the other weft threads.

With the above-described arrangement according to the fourth embodiment of the present invention, the upper binding warp thread 12 and lower binding warp threads 13, 13' make it possible to maintain the perpendicularity of the upper and lower legs of each fastener element with respect to the plane of the tape, and to stabilize the spacing between the fastener elements. The warp threads 16 are fastened tightly in such a manner that the continuous monofilament 11' forms a portion of the tape. Furthermore, the warp threads 17, 17 cross each other in the gaps between neighboring fastener elements to fill these gaps, thereby preventing the intrusion of dust and, in cooperation with the retaining grooves c, c' formed in the respective upper and lower legs of the fastener elements, assuring that the upper and lower warp threads will not slide off the fastener elements.

Since the woven slide fastener according to the fourth embodiment of the present invention has the upper and lower binding warp threads held in an engaging relation with the retaining grooves formed in the upper and lower legs of each fastener element, there is reduced risk of failure wherein these binding warp threads shift toward the coupling heads or heels and slip off the fastener elements while in use, thus weakening the slide fastener. Since the existence of the retaining grooves also facilitates holding of the binding warp threads during weaving, rejects are produced less frequently and machining speed can be raised during manufacture. The end result is a major reduction in manufacturing cost.

Figure 17:
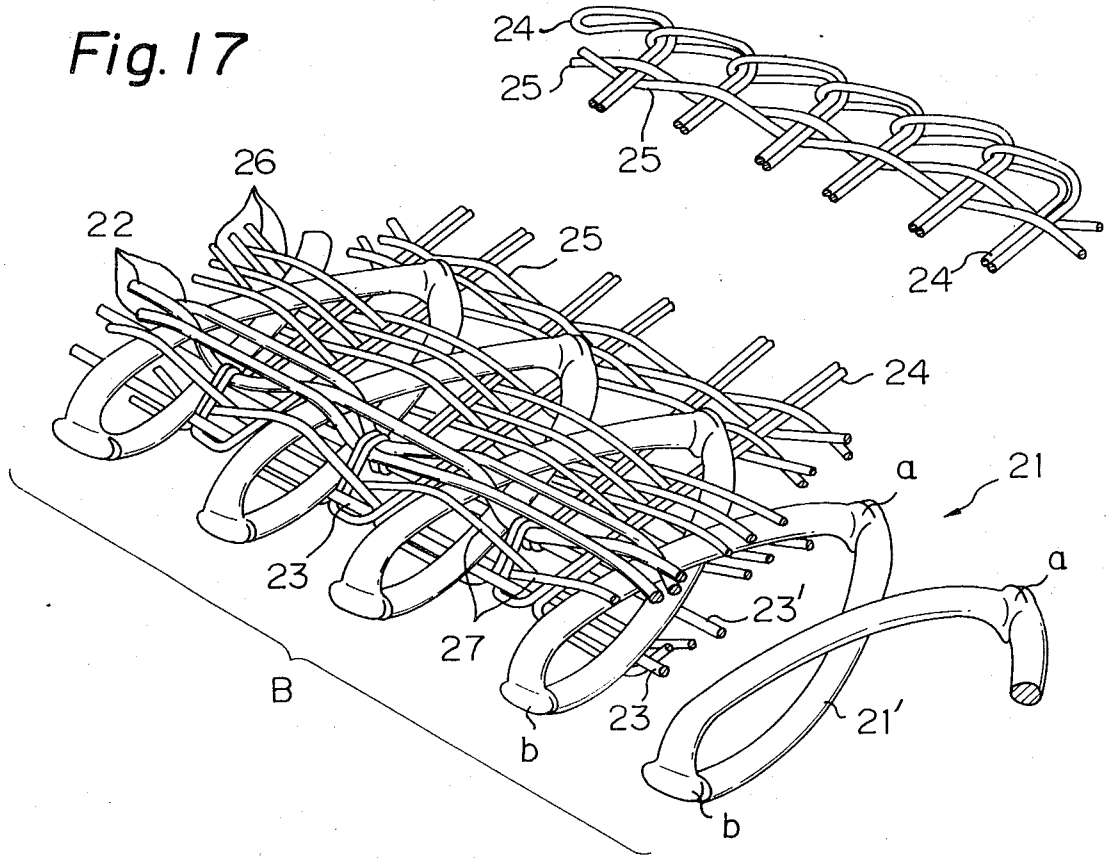
FIG. 17 is a perspective view illustrating part of a fifth embodiment of the present invention.
Figure 18:
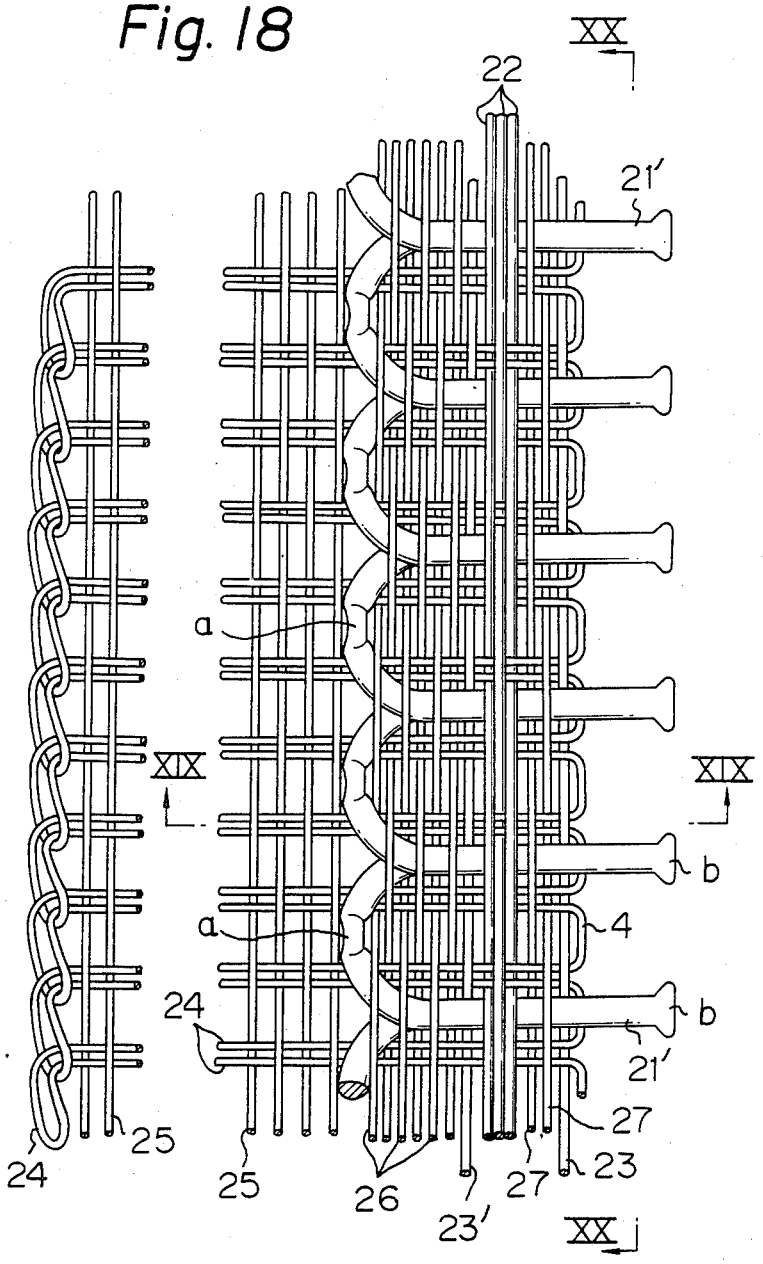
FIG. 18 is a plan view of the embodiment shown in FIG. 17.
Figure 19:
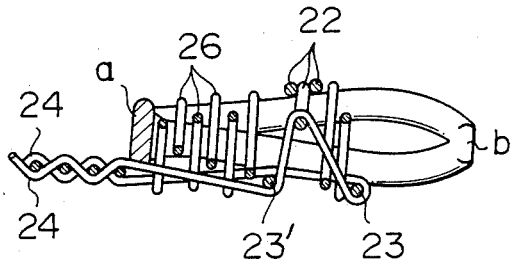
FIG. 19 is a transverse sectional view taken along line XIX—XIX of FIG. 18.
Figure 20:
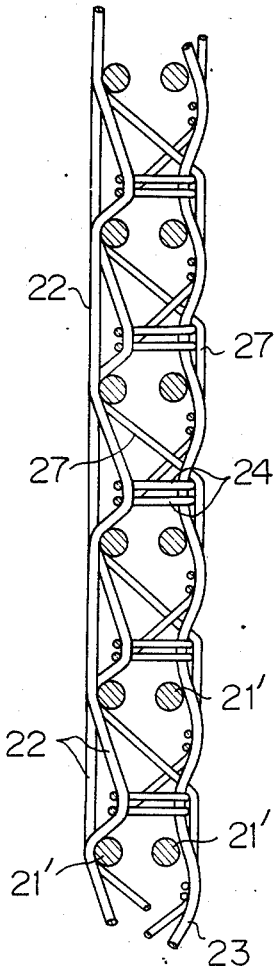
FIG. 20 is a longitudinal sectional view taken along line XX—XX of FIG. 18.

FIGS. 17 through 20 illustrate a fifth embodiment of a woven slide fastener according to the present invention. FIG. 17 is a perspective view illustrating a principal portion of a woven fastener which includes a continuous, synthetic resin monofilament supplied as a double weft and woven into one longitudinal side edge of a fastener tape as the tape is being woven. A flat coil 21 comprises a continuous monofilament 21', which has been deformed under pressure at regular intervals, and is produced by winding the monofilament 21' into a coil while the monofilament is bent at the deformed portions to form heel portions a and coupling head portions b. Each heel portion a is formed by bending the monofilament 21' back over itself in a plane containing the longitudinal axis of the coil, or in a plane which is inclined slightly with respect to the first-mentioned plane. Each coupling head portion b is formed by bending the monofilament 21' in a plane which is generally perpendicular to the longitudinal coil axis. Each fastener element unit comprises a coupling head portion b, an upper leg and a lower leg and is connected at the ends of the legs, namely at its heel portions a, with a fastener element unit at either side thereof to construct an element row B forming the flat coil.

Three upper binding warp threads 22, 22, 22 extend along the upper side of the element row, namely the upper legs of the elements, and two lower binding warp threads 23, 23' extend along the lower side of the element row, namely the lower legs of the elements. A weft thread 24 is interlaced with the upper and lower binding thread 22, 23, 23' between the adjacent fastener element units, tightly secures the binding warp threads 22 and the binding warp threads 23, 23' from both sides thereof, extends outwardly of the coil beyond the heel portions a and is interlaced with the other warp threads 25 to form a tape web. The weft thread 24 forms a loop at the longitudinal side edge of the tape web, with mutually adjacent individual loops being intertwined to form an ear portion along the side edge of the tape. A warp thread 25 is interlaced with the weft thread 24 to form the tape web. A warp thread 26 for fastening the coil is woven in at 2/2 with respect to the weft thread 24 and at 1/1 with respect to the double weft threads of the continuous monofilament 21', and is interlaced with the weft thread 24 and with the continuous monofilament 21' of the flat coil 21 to weave the flat coil as a portion of the tape web. Warp threads 27 are interlaced with the continuous monofilament 21' of the flat coil among the binding warp threads 22, 23, 23' on the upper and lower sides thereof to fill the gaps of the coupling head sides between mutually adjacent fastener elements. The upper binding warp threads 22 and lower binding warp threads 23, 23' are thicker and stronger than the other warp threads and have greater elasticity than the weft thread.

The fifth embodiment of the present invention, which has the advantageous features of the first through third embodiments, has an additional characterizing feature which will now be described.

Specifically, the weft thread 24, while being woven together with the warp threads 25, 26 to form the tape web, is interlaced with the warp threads 26 between the adjacent fastener element units, is passed underneath the lower binding warp thread 23', wound around the lower binding warp thread 23 from above on the inner side thereof to below on the outer side thereof, and is then stretched to interlace one or more (but not all) of the upper binding warp threads 22, 22, 22. Then, some of the upper binding warp threads 22 which is interlaced with the weft threads fall in the gap between the fastener element units. Thereafter, while again being woven together with the warp threads 25, 26 to weave the tape web, the weft thread 24 is brought to the side edge of the tape and interlaced with a loop to form the next loop. Repeating these steps forms a woven slide fastener. In the illustrated fifth embodiment, the upper binding warp thread 22 and lower binding warp threads 23, 23' make it possible to maintain the perpendicularity of the upper and lower legs of the coupling head of each fastener element with respect to the plane of the tape, and to stabilize the spacing between the coupling heads. The warp threads 26 are fastened tightly in such a manner that the continuous monofilament 21' forms a portion of the tape. Furthermore, the warp threads 27, 27 cross each other in the gaps between neighboring fastener element units to fill these gaps in cooperation with falling of the upper binding warp threads 22, thereby preventing the intrusion of dust and assuring that the upper and lower warp threads will not slide off the fastener elements.

According to the construction of the fifth embodiment of the woven slide fastener, the upper binding warp threads 22, 22, 22 secured between adjacent fastener elements by being interlaced with the weft thread also fill the spaces between the adjacent fastener elements. This prevents the intrusion of dust to an even greater extent than the woven slide fastener of the first through third embodiments. Further, the upper binding warp threads extend perfectly straight and are present between all of the mutually adjacent fastener elements to enhance the stability of the fastener element pitch.

As many apparently widely different embodiments of the present invention can be made without departing from the spirit and scope thereof, it is to be understood that the invention is not limited to the specific embodiments thereof except as defined in the appended claims.

What is claimed is:

1. A woven slide fastener which comprises:

a fastener element row in the form of a flat coil composed of a continuous monofilament having a number of turns, each turn of the flat coil constituting a separate fastener element having a single coupling head, an upper leg and a lower leg, each fastener element including a heel formed by bending the continuous monofilament near a boundary of a neighboring fastener element substantially in a plane containing an axis of the flat coil, the coupling head being formed by bending the continuous monofilament having a single coupling head, an upper leg and a lower leg, each fastener element including a heel formed by bending the continuous monofilament near a boundary of a neighboring fastener element substantially in a plane containing an axis of the flat coil, the coupling head being formed by bending the continuous monofilament in a plane substantially orthogonal to the axis of the flat coil;

a slide fastener tape including a tape body having a first longitudinal tape edge into which the fastener elements are woven and a second longitudinal tape edge opposite said first longitudinal tape edge;

first warp threads woven into the tape body;

second warp threads woven along said first longitudinal tape edge and extending alternatively about the upper side of the upper legs and the lower side of the lower legs of said elements;

an upper binding warp thread positioned outside of the upper legs and nearer to the coupling heads than said second warp threads and extending along an upper side of an upper leg of said fastener element;

a lower binding warp thread positioned outside of the lower legs and nearer to the coupling heads than said second warp thread and extending along a lower side of a lower leg of said fastener element; and a weft thread woven into said first and second warp threads so as to cross and interlace with said upper and lower binding warp threads.

2. A woven slide fastener according to claim 1, wherein said upper and lower binding warp threads are thicker than said first and second warp threads and thicker than said weft thread.

3. A woven slide fastener according to claim 1 or claim 2, wherein at least some of said second warp threads cross and interlace with said fastener element row at a position offset toward the coupling head from said upper binding warp thread, thereby filling gaps between mutually adjacent coupling heads.

4. A woven slide fastener according to claim 1 or claim 2, wherein said weft thread crosses and interlaces with said upper and lower binding warp threads in a figure-eight configuration.

5. A woven slide fastener according to claim 1, wherein each fastener element has upper and lower retaining grooves formed in the continuous monofilament on the upper and lower legs respectively, said upper retaining groove receiving said upper binding warp thread, and said lower retaining groove receiving said lower binding warp thread.

6. A woven slide fastener according to claim 1, wherein at least two upper binding warp threads are provided, all of said upper binding warp threads save at least one crossing and interlacing with said weft thread at all times.

* * * * *